US005467537A

United States Patent [19]

Aveni et al.

[11] Patent Number: 5,467,537

[45] Date of Patent: Nov. 21, 1995

[54] SHOE WITH ADJUSTABLE CLOSURE SYSTEM

[75] Inventors: Michael A. Aveni, Lake Oswego; Daniel R. Potter, Forest Grove, both of Oreg.

[73] Assignee: Nike, Inc., Beaverton, Oreg.

[21] Appl. No.: 214,742

[22] Filed: Mar. 18, 1994

[51] Int. Cl.[6] ..... A43B 11/00; A43B 3/12; A44B 9/00

[52] U.S. Cl. ..... 36/50.1; 36/11.5; 24/712.1

[58] Field of Search ..... 36/50.1, 11.5, 36/88, 89, 92, 99, 114; 24/712.1, 712.2, 712.5, 714.8, 713.4

[56] References Cited

U.S. PATENT DOCUMENTS

| | | | |
|---|---|---|---|
| 87,655 | 3/1869 | Foster | 24/714.8 X |
| 175,367 | 3/1876 | Mayreis . | |
| D. 338,320 | 8/1993 | Haggar | D2/270 |
| 2,081,514 | 5/1937 | Spielberger . | |
| 2,122,442 | 7/1938 | Segal . | |
| 2,204,627 | 6/1940 | Segal . | |
| 2,212,121 | 8/1940 | Krakauer . | |
| 2,390,685 | 12/1945 | Benson | 36/11.5 |
| 2,801,478 | 3/1957 | Gilbert | 36/11.5 X |
| 3,059,351 | 10/1962 | Hawkins et al. | 36/50.1 |
| 3,546,796 | 12/1970 | Adams | 36/50.1 X |
| 4,530,171 | 7/1985 | Zabala | 36/11.5 |
| 4,631,840 | 12/1986 | Gamm | 36/50.1 |
| 4,942,678 | 7/1990 | Gumbert | 36/102 |
| 5,117,882 | 1/1993 | Berger | 36/50.1 |
| 5,371,957 | 12/1994 | Gaudio | 36/50.1 |

FOREIGN PATENT DOCUMENTS

| | | | |
|---|---|---|---|
| 2661074 | 10/1991 | France | 36/11.5 |
| 452855 | 11/1949 | Italy | 36/11.5 |

*Primary Examiner*—Paul T. Sewell
*Assistant Examiner*—BethAnne C. Cicconi
*Attorney, Agent, or Firm*—Banner & Allegretti, Ltd.

[57] ABSTRACT

A shoe having a closure system is disclosed. The shoe has an upper and a sole attached to the upper. A first strap member is attached to the medial side of the shoe at two longitudinal locations. A second strap member is attached to the lateral side of the shoe at two longitudinal locations. A first adjusting member is slidably coupled to both the first and second strap members. The first adjusting member is slidable along the first and second strap members towards the front of the foot to tighten the upper about the forefoot of the foot. A second strap member is slidably coupled to both the first and second strap members. The second adjusting member is slidable along the first and second strap members toward the rear of the foot to tighten the upper about the ankle and heel of the foot.

43 Claims, 7 Drawing Sheets

SHOE WITH ADJUSTABLE CLOSURE SYSTEM

BACKGROUND OF THE INVENTION

1. Field of the Invention

The present invention is directed to a shoe with an improved tightening system, and in particular to a tightening system including strap members disposed on the medial and lateral sides of the shoe and adjusting members slidably coupled to the strap members such that the shoe can be adjustably secured about the forefoot, ankle and heel of the foot.

2. Description of the Prior Art

Numerous techniques are known in the prior art for securing or tightening a shoe to a foot. The most typical, and relatively simple technique, is the use of a lacing system. In a simple form of a lacing system, the upper is slit down its middle along the instep area, and eyelets are located along either side of the slit. A lace is passed through the eyelets and crisscrossed across the slit from the bottom of the slit to the top of the slit. By pulling on the upper free ends of the lace, the slit portions of the upper are drawn toward one another, and the shoe is tightened to the foot.

There are many variations to this basic form of lacing system. For example, the eyelets can be located at various widths across the slit in the upper such as shown in U.S. Pat. No. 4,255,876 or the use of speed laces in combination with a variable width lacing such as disclosed in U.S. Pat. No. 4,553,342.

Tightening systems using laces have the disadvantage of requiring the fixing and tying of the extraneous lace in place through the eyelets in the shoe upper. The use of laces and eyelets also does not allow easy adjustment and tightening about the forefoot of the shoe. In order to adjust the forefoot tightness in a shoe using a lace, the lace is loosened in the rearward eyelets so the shoe wearer can tighten the lace in the forward eyelets and then the slack taken up through the rearward eyelets and the lace tied across the ankle. Further, a lace system normally requires two hands for tightening and adjusting and cannot readily be done by children because of the required knot tying in the lace. Still further, a lace system is not easily released and requires the untying of the lace knot and the loosening of the laces in the eyelet in order to remove the shoe from the foot. Thus, removal of a shoe using a lace and eyelet system may, and often does, require the use of both hands of the shoe wearer. The lacing and knot of a lace and eyelet system also have the disadvantage of being a bulky and high-profile structure on the top of the foot thus detracting from the look of the shoe and the comfort along the top of the wearer's foot.

Other tightening systems known in the prior art use wires disposed on both sides of the slit in the upper along the instep area of the foot. These wires generally take the place of, and are positioned where the eyelets of a lace and eyelet system would be disposed. U.S. Pat. No. 175,367 discloses a fastening system wherein a wire is attached at numerous points along each side of the slit in the upper. The rearward/upper ends of the wires appear to be attached to the upper at a position in front of the ankle. The clasps are fastened on the wires low down where they come close together, and are then moved upward to draw the shoe tight, and to unfasten the shoe, the clasps are first moved down as far as they will go.

U.S. Pat. Nos. 3,059,351 and 4,631,840 disclose fastening devices wherein wires are disposed along both edges of the slit in the upper where the eyelets of a lace and eyelet system would be disposed. In an unfastened position, a rigid sliding member holds the wires a fixed distance apart at the forward portion of the slit. The rigid sliding member is attached to a pivotally mounted plate. In order to fasten the shoe about the foot, the plate is pivoted upwards towards the rear of the shoe thus moving the rigid member rearward along the wires and bringing the rearward ends of the wires into a closer relationship.

The above described wire-closure systems do not allow the upper to be adjustably tightened about the forefoot. The forward ends of the wires are positioned on top of the foot and the clasp/sliding members are moved rearward from the forward portions of the wires to close the slit in the upper. The clasp/sliding members are not moved forward to adjustably tighten the shoe about the forefoot. Additionally, the rearward ends of the wires appear to be attached in front of the ankle. Thus, the wire-closure systems described above do not appear to suitably tighten the shoe in the heel area or along the side of and around the ankle.

SUMMARY OF THE INVENTION

The present invention is directed to a shoe having a closure system wherein the shoe has an upper and a sole attached to the upper. A first strap portion extends along the medial side of the shoe and a second strap portion extends along the lateral side of the shoe. A first adjusting member is slidably coupled to both the first and second strap portions and is slidable along the first and second strap portions towards the front of the foot to tighten the upper about the forefoot of the foot. A second adjusting member is slidably coupled to both the first and second strap portions and is slidable along the first and second strap portions towards the rear of the foot to tighten the upper about the ankle and heel of the foot. The first and second strap portions can be formed of separate members or can be formed of a single member.

In a further embodiment, the first strap member is attached at a first location in the forefoot portion of the shoe and at a second location in the heel portion of the shoe. The second strap member is attached at a first location in the forefoot portion of the shoe and at a second location in the heel portion of the shoe.

The present invention provides the advantage of the ability to adjustably tighten the shoe about the forefoot of the foot. Further, the shoe wearer does not need to tie or fix laces in place. Further, the closure system can be adjusted using one hand and is fast, easy and accurate such that children can do it. Additionally, the closure system can be quickly released and can be released using one hand. Still further, the closure system provides for increased adjustability in the heel area of the shoe and around the ankle of the foot. Also, the closure system is a self-contained system and does not require an extraneous lace. The closure system also provides for a low-profile, attractive appearance of the shoe which is not bulky or uncomfortable on the top of the wearer's foot.

DETAILED DESCRIPTION OF THE PREFERRED EMBODIMENTS

Figure 6:
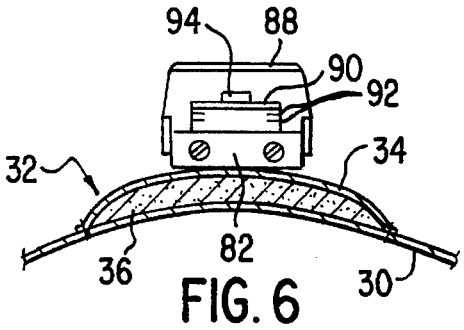
FIG. 6 shows a sectional view taken along line 6—6 of FIG. 2.

With reference to FIGS. 1–4, a shoe having a closure system according to the present invention is shown. The shoe includes a conventional sole 20, which typically includes a conventional outsole 21 and a conventional midsole 23. Upper 26 is secured to the upper surface of sole 20 and includes vamp 28 and medial and lateral quarters 30 which are made of a conventional material, for example synthetic or natural leather. Medial and lateral quarters 30 are made of a continuous layer of material such that the layer extends over the top of the foot and around the heel of the foot. Quarter layer 30 can be made of a different material than vamp 28 for conforming to the shape of the foot, for example neoprene or any other elastic material. Padded instep portion 32 is positioned where the throat, laces and eyelets of a normal shoe would be. With reference to FIG. 6, padded instep portion 32 consists of outer layer 34 stitched to quarter layer 30 and padding 36 disposed between quarter layer 30 and outer layer 34.

The shoe can be divided into three general portions or sections which relate roughly to the three areas of the foot of the wearer. A heel portion is located generally rearward of line $L_2$; an arch portion is located generally between lines $L_1$ and $L_2$; and a forefoot portion is located generally forward of line $L_2$. Lines $L_1$ and $L_2$ are intended to be diagrammatic and not to indicate precise lines of demarcation between the heel, arch and forefoot portions of the shoe. Lines $L_1$ and $L_2$ are indicated in the figures for the convenience of describing the present invention only. As is apparent, a shoe is not necessarily divided into three sections, but can also be divided into other sections.

Figure 1:
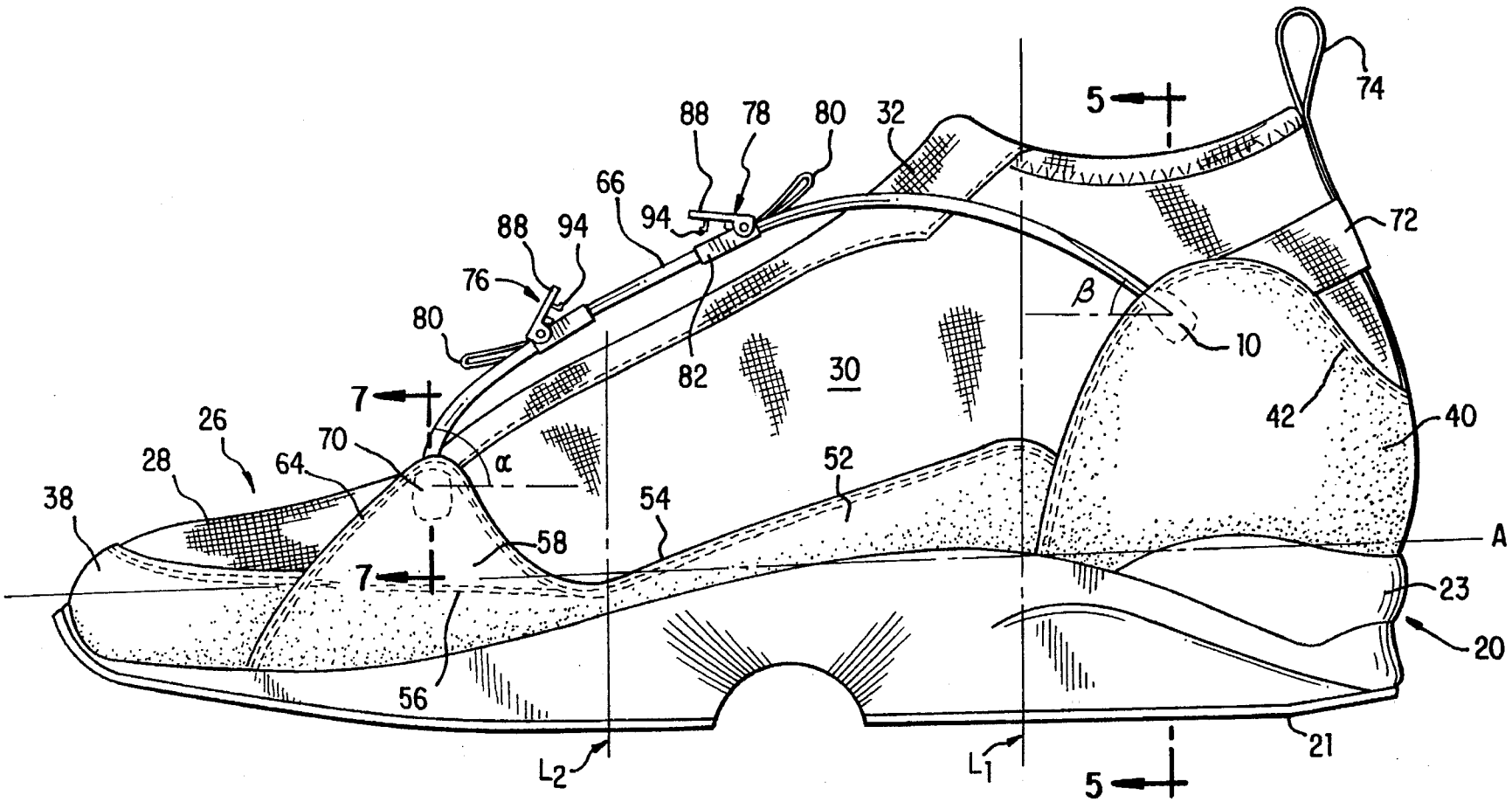
FIG. 1 shows a side elevational view of the medial side of a right shoe having a closure system in accordance with the present invention with the closure system in an untightened position.
Figure 5:
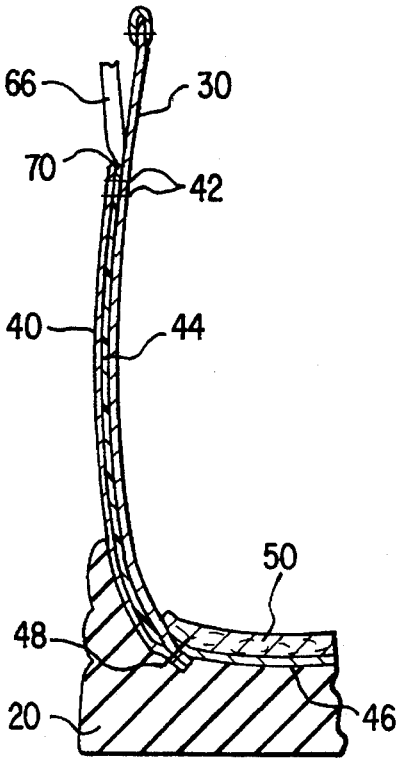
FIG. 5 shows a sectional view taken along line 5—5 of FIG. 1.

Toe reinforcing tip 38, made of for example natural or synthetic leather, is stitched to vamp 28 at the forwardmost end of the shoe. With reference to FIGS. 1 and 5, foxing 40, made of for example synthetic or natural leather, is stitched to quarter layer 30 along dual stitch line 42. Foxing 40 extends from the medial heel portion of the shoe around the back of the shoe, and to the lateral heel portion of the shoe. Foxing 40 covers heel counter 44 which also extends from the medial heel portion of the shoe around the back of the shoe and to the lateral heel portion of the shoe.

Heel counter 44 is made of a relatively rigid material, for example a plastic, such as a thermoplastic urethane. As shown in FIG. 5, heel counter 44 is positioned in between foxing 40 and quarter layer 30. Adhesive or glue can be positioned on the inner and outer surfaces of heel counter 44 to bond heel counter 44 to both quarter layer 30 and foxing 40. With further reference to FIG. 5, the lower end of foxing 40 and the lower end of quarter layer 30 are stitched together and to insole board 46 by stitch line 48. Insole board 46 can be made of a relatively stiff, sturdy material, for example cardboard or TEXON®, and extends along the top of sole 20 in the heel, arch and forefoot portions of the shoe. Alternatively, the shoe can be constructed with slip lasted, California lasted or partially board lasted techniques. The insole board can be eliminated, or located in only the heel area. Stitch line 48 extends around the entire perimeter of the shoe along the top surface of sole 20. In the heel portion of the shoe, foxing 40, quarter layer 30, and insole board 46 are attached together by stitch line 48 in a stitching arrangement wherein quarter layer 30 is located on top of foxing 40 and insole board 46 is located on top of quarter layer 30. Sock liner 50 is positioned throughout the inside of the shoe on top of insole board 46.

Reinforcing side sections 52 are positioned on the medial and lateral sides of the shoe and extend generally from foxing 40 to reinforcing tip 38. Reinforcing side sections 52 extend generally from the heel portion of the shoe, through the arch portion of the shoe, and into the forefoot portion of the shoe. Reinforcing side sections 52 are attached to quarter layer 30 and vamp 28 along upper edge 54 by dual stitch line 56. The lower portion of each reinforcing side section 52 is in contact with the top of sole 20 and can be attached thereto by for example adhesive, glue, or stitching. Further, the lower portion of each reinforcing side section 52 can be stitched to either the lower end of quarter layer 30 (if located generally in the arch portion of the shoe) or the lower end of vamp 28 (if located generally in the forefoot portion of the shoe), and to insole board 46 by stitching 48 in an arrangement similar to that shown in FIG. 5. That is, insole board 46 can be positioned on top of either the lower end of quarter layer 30 or the lower end of vamp 28, and the lower portion of each reinforcing side section 52 positioned below either the lower end of quarter layer 30 or the lower end of vamp 28. Reinforcing side sections 52 can be made of a conventional material, for example synthetic or natural leather. As described above, stitch line 48 extends around the entire perimeter of the top of sole 20 and is generally used to attach quarter layer 30 and vamp 28 to insole board 46. Further, as described above, stitching line 48 can also be used to attach the lower ends of foxing 40, reinforcing side sections 52, or toe reinforcing tip 38 to quarter layer 30 or vamp 28 and to insole board 46. The combination of structures or layers attached along stitch line 48 are attached to the top of sole 20 by any suitable means, for example adhesive, glue, or stitching.

Figure 7:
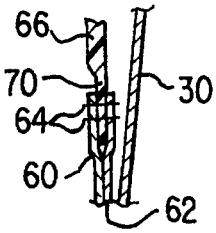
FIG. 7 shows a sectional view taken along line 7—7 of FIG. 1.

Forefoot triangular attaching flaps 58 are disposed on the medial and lateral sides of the shoe and extend upward from reinforcing side sections 52. With reference to FIG. 7, outer layer 60 of attaching flaps 58 can be made of the same layer of material as reinforcing side sections 52. Attaching flaps 58 also have inner layer 62 attached to outer layer 60 along dual stitch line 64. Additionally, outer layer 60 and inner layer 62 can be attached together by, for example, glue or adhesive. Attaching flaps 58 are not attached to quarter layer 30 or vamp 28 above stitching line 56. Thus, attaching flaps 58 can be moved inward and outward with respect to quarter layer 30 or vamp 28. Attaching flaps 58 can be made of a generally non-elastic, non-stretch material, for example synthetic or natural leather.

Figure 2:
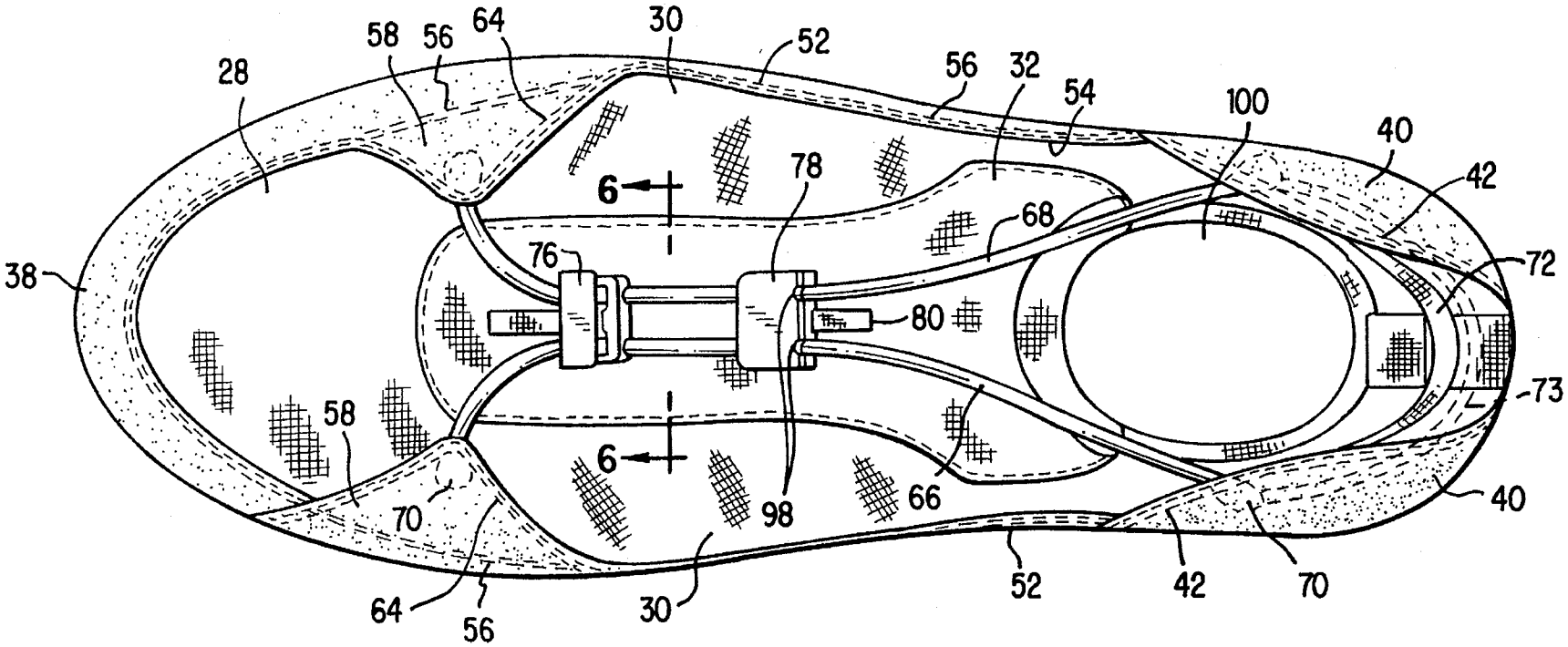
FIG. 2 shows a top plan view of the shoe shown in FIG. 1 with the closure system in the untightened position.

With reference to FIGS. 1–4, first strap member or cord 66 is positioned on the medial side of the shoe and second strap member or cord 68 is positioned on the lateral side of the shoe. First and second strap members 66 and 68 are cylindrical in shape and are preferably made of an elastic material, for example urethane. The strap members can be made to have a range of elongation from 1% to 40% and preferably 1% to 8%. This range of elongation is of the strap member itself rather than the material of which the strap is made. With reference to FIGS. 5 and 7, the forward ends and rearward ends of first and second strap members 66 and 68 have flattened portions 70 for attachment to upper 26. With reference to FIGS. 1, 2 and 7, the forward ends of first and second strap members 66 and 68 are attached to triangular attaching flaps 58. Flattened portions 70 are each positioned or sandwiched in between attaching flap outer layer 60 and attaching flap inner layer 62 and held in place by stitch line 64. Adhesive or glue can be used in addition to or as an alternative to the stitching in order to attach strap members 66 and 68 to attaching flaps 58. Furthermore, flattened portions 70 of strap members 66 and 68 can be attached to attaching flaps 58 about a pivot point. For instance, a rivet or the like can be positioned through portions 70 and flaps 58 to form a pivot point such that strap members 66 and 68 can pivot about the pivot point.

The longitudinal location of the attachment of the forward ends of straps 66 and 68 is preferably positioned in the forefoot portion of the shoe along the side of the shoe. Further, the longitudinal location of the point of attachment of the forward ends of the strap members is preferably at or behind the heads of the metatarsal bones of the foot. The attachment of the forward ends of first and second strap members 66 and 68 are at an angle $\alpha$ to the longitudinal axis A of the shoe as shown in FIG. 1. Angle $\alpha$ faces toward the rear of the shoe and is preferably approximately 90°.

The rearward ends of strap members 66 and 68 are each attached to upper 26 in the heel portion of the shoe. With reference to FIG. 5, flattened portions 70 of the rearward ends of strap members 66 and 68 are each positioned in between foxing 40 and quarter layer 30. Strap members 66 and 68 are held in position by dual stitch line 42 which passes through each flattened portion 70.

Figure 5A:
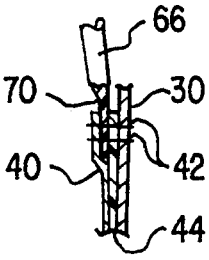
FIG. 5A shows a sectional view similar to FIG. 5 but showing an alternative attaching arrangement for the strap member.

With reference to FIG. 5A, an alternative attaching arrangement is shown wherein each flattened portion 70 of the rearward ends of strap members 66 and 68 is attached to heel counter 44 such that dual stitch line 42 passes through foxing 40, flattened portion 70, heel counter 44, and quarter layer 30. Further, as with the forward ends of strap members 66 and 68, the rearward ends of strap members 66 and 68 can be pivotally attached to any of foxing 40, heel counter 44, quarter layer 30 or any combination thereof. Such pivotal attachment can be with a rivet or the like such that the rearward ends of the strap members can pivot about the point of attachment.

The location of the attachment of the rearward ends of strap members 66 and 68 is preferably along the side of the upper in the heel portion of the shoe. Further, the location of attachment of the rearward ends of the strap members is preferably along the side of the ankle of a foot disposed in the shoe. With reference to FIG. 1, the rearward attaching points of strap members 66 and 68 generally form an angle $\beta$ with respect to longitudinal axis A of the shoe. Angle $\beta$ faces towards the front of the shoe and is preferably approximately 45°.

Upper 26 also has elastic strap 72 attached to quarter layer 30 along the back of the heel portion of the shoe to provide better fit across the back of the heel of a wearer. Additionally, pull tab 74 is attached to the rearward portion of quarter layer 30 to aid in positioning the shoe on a wearer's foot.

With reference to FIG. 2, an alternative attaching arrangement is depicted for the rearward ends of strap members 66 and 68. As shown in dotted lines generally at 73, strap members 66 and 68 can be made of a single construction and wrap around the back of the shoe upper. In such an arrangement, the single construction of strap members 66 and 68 can extend through a tunnel-like opening formed in between any of the layers used to form the upper construction in the heel area of the shoe. Thus, the single strap member can wrap around the back of the shoe through the tunnel-like opening.

With reference to FIGS. 1–4, a first adjustable member or slider 76 is slidably coupled to first and second strap members 66 and 68 such that it can be slidably moved forward and rearward along the strap members. Second adjustable member or slider 78 is also slidably coupled to first and second strap members 66 and 68 such that it too can be moved forward and rearward along the strap members. Second adjustable member 78 is positioned rearward or behind first adjustable member 76. First and second adjustable members 76 and 78 each have pull loops 80 to aid in moving the adjustable members along strap members 66 and 68.

Figure 8:
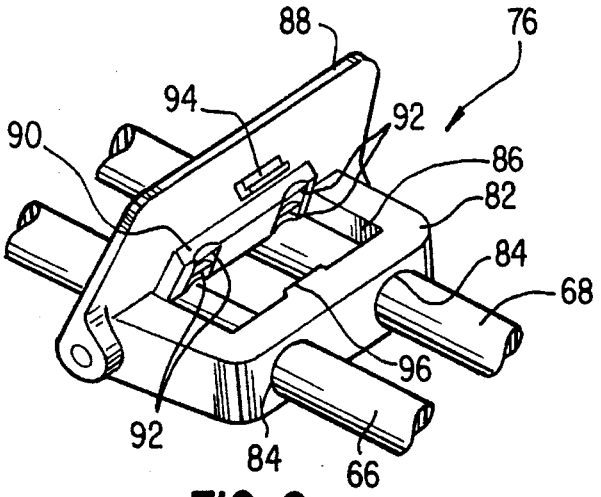
FIG. 8 shows a perspective view of an adjusting member for the closure system of the present invention.
Figure 9:
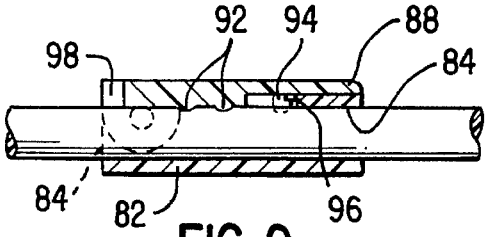
FIG. 9 shows a sectional view of the adjusting member of FIG. 8 taken along line 9—9 of FIG. 3.

The construction of first and second adjustable members 76 and 78 is identical. Each adjustable member has a holding mechanism for fixing the adjustable member at a position along the strap members. With reference to FIGS. 8 and 9, the structure of first adjustable member 76 will be described. With reference to FIG. 8 which shows adjustable member 76 in an unlocked position and with loop 80 removed, base 82 of adjustable member 76 has apertures 84 in which are disposed first and second strap members 66 and 68. Apertures 84 allow adjustable member 76 to slide along strap members 66 and 68 when adjustable member 76 is in an unlocked position as shown in FIG. 8. Base 82 has a rectangular cutout portion 86 which exposes strap members 66 and 68. Hinged member 88 is rotatably attached to base 82 and is movable between a locked and unlocked position. Boss 90 is disposed on the bottom surface of hinged member 88 and has gripping structures 92. Hinged member 88 also has latch 94 disposed on its lower surface. FIG. 9 shows the adjustable member in a locked position. Latch 94 engages protrusion 96 disposed on base 82 to hold the adjustable member in the locked position. In the locked position, gripping structures 92 engage, press into and deform the top surface of strap members 66 and 68 to hold adjustable member 76 in a particular position along the strap members. Thus, in order to hold the adjustable number at a particular position along the strap members, hinged member 88 is simply rotated downward and snapped in place by the shoe wearer.

Figure 3:
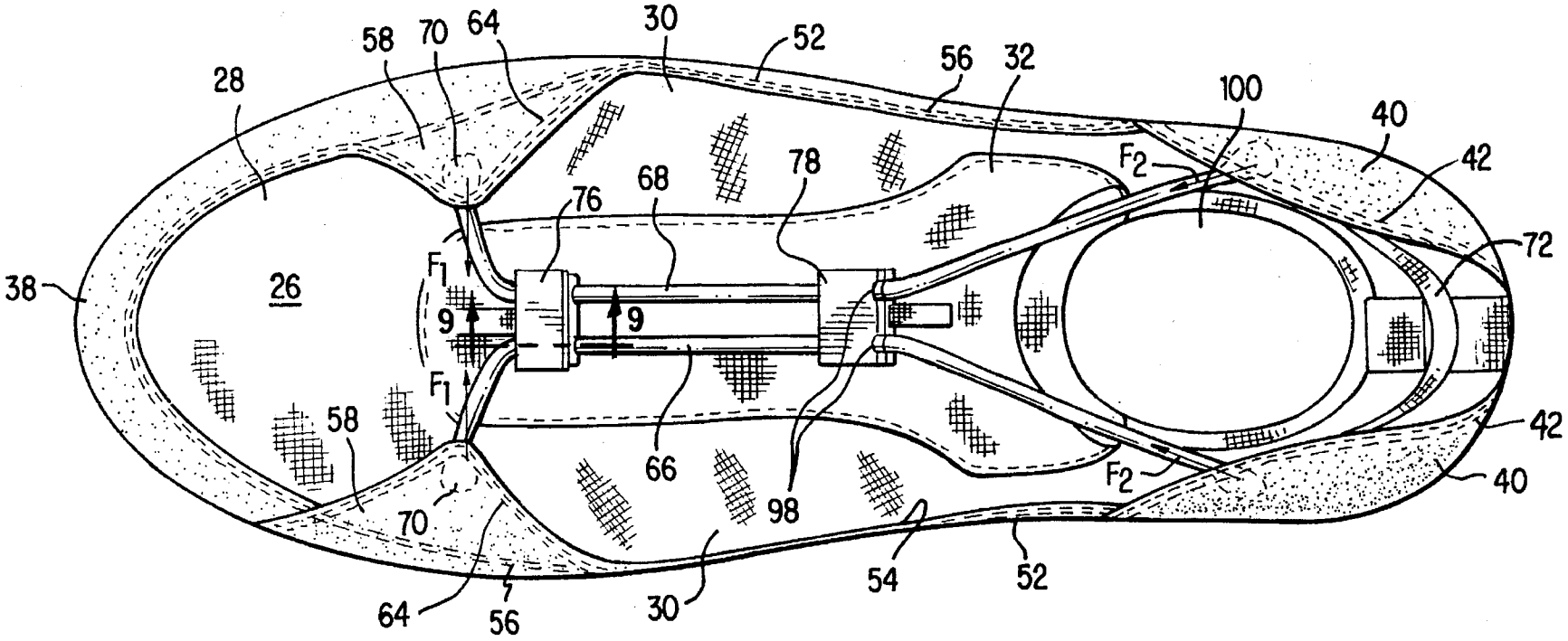
FIG. 3 shows a top plan view of the shoe shown in FIG. 1 with the closure system in a tightened position.

With further reference to FIGS. 2, 3 and 9, arcuate cutout portions 98 are shown disposed on the hinged end of hinged member 88. These arcuate portions allow hinged member 88 to rotate upward to an unlocked position without engaging or interfering with strap members 66 and 68.

With reference to FIGS. 1–4, the tightening and untightening of the closure system is described. FIGS. 1 and 2 show the closure system in an untightened position. In the untightened position, first and second adjustable members 76 and 78 are positioned at intermediate points along strap members 66 and 68 such that intermediate portions of first and second strap members 66 and 68 in between the adjustable members are held in a generally parallel relationship to each other. Hinged members 88 of first and second adjustable members 76 and 78 are in an upward unlocked position such that the adjustable members are free to slide along the strap members. As seen in FIG. 1, first and second strap members 66 and 68 have an arcuate shape when the closure system is in the untightened position. The concave portion of the arcuate shape faces downward or towards the sole of the shoe. The arcuate shape is mainly due to the length of strap members 66 and 68 and the angles $\alpha$ and $\beta$ at which the ends of the strap members are attached to the upper. The length of the strap members is such that adequate slack is present in the strap members to allow insertion of the foot in the upper when the closure system is in the untightened position. The angles of attachment $\alpha$ and $\beta$ can be such as to aid the tightening of the upper about the forefoot, arch and heel portions of the foot, as will be described more fully below. With the closure system in the untightened position, the foot of the shoe wearer is inserted in foot opening 100.

In order to tighten and secure the shoe about the foot, first and second adjustable members 76 and 78 are moved away from one another by the shoe wearer. Thus, first adjustable member 76 is moved or slid forward along the strap members such that the forward sections of the arch portion of the shoe and the forefoot portion of the shoe are tightened about the foot. Second adjustable member 78 is moved or slid rearward along the strap members such that the rearward sections of the arch portion of the shoe and the heel portion of the shoe are tightened about the foot. First adjustable member 76 can be slid or moved forward and second adjustable member 78 can be slid or moved rearward simultaneously by the shoe wearer in order to tighten the shoe about the foot. Further, first and second adjustable members 76 and 78 can be moved separately at different times to adjustably tighten different portions of the upper about the foot at various times.

Once first and second adjustable members 76 and 78 are in suitable positions such that the upper of the shoe is suitably tightened about the foot, hinged members 88 of first and second adjustable members 76 and 78 are pivoted downward into their locked position to hold the adjustable members in position along the strap members. First and second adjustable members 76 and 78 can be locked in position simultaneously or at different times depending upon the desires of the shoe wearer. As described above, the locked position of the adjustable members is shown in FIG. 9.

Pull loops 80 can be used by the shoe wearer to adjust the position of the adjustable members. However, the shoe can be tightened equally well without the pull loops.

Figure 4:
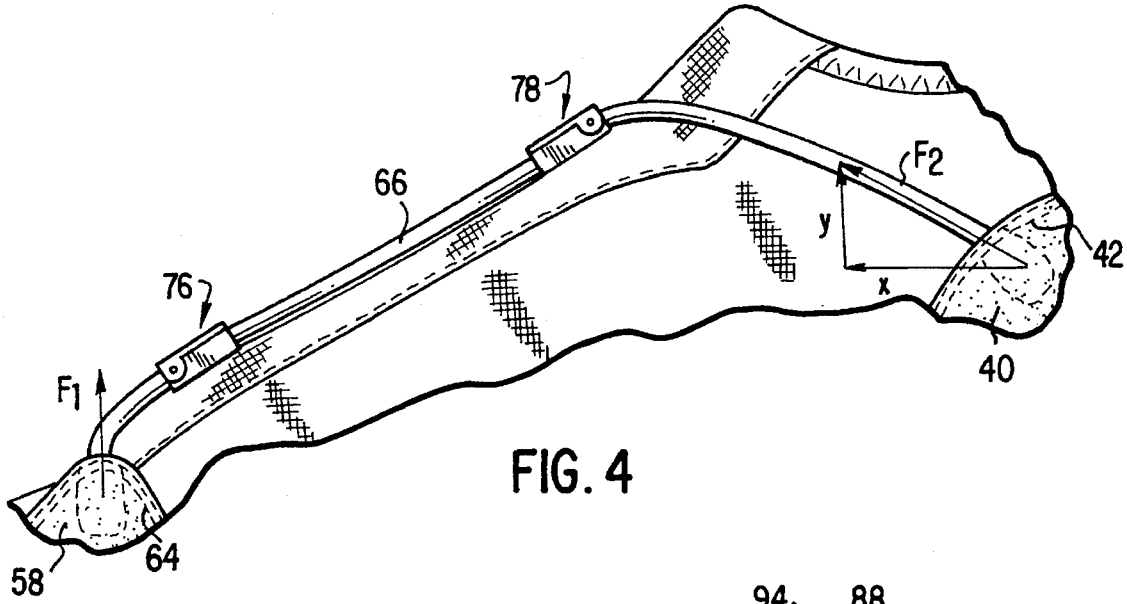
FIG. 4 shows a partial side elevational view of the shoe shown in FIG. 1 with the closure system in the tightened position.

The tightened position of the closure system is shown in FIGS. 3 and 4. By moving first adjustable member 76 forward, the forward sections of the arch portion of the upper and the forefoot portion of the upper are drawn closer together across the arch and forefoot portions of the foot. The positioning of the forward ends of strap members 66 and 68 along the side of the forepart portion of the upper provide for this tightening in the forward portions of the upper. Further, the attachment of the forward ends of first and second strap members 66 and 68 at an angle $\alpha$ (which is preferably approximately 90° ) allows a force $F_1$ directed inward toward the center of the shoe and substantially perpendicular m the shoe's longitudinal axis A to be exerted on each attaching flap 58 such that the upper is tightened about the forefoot. In other words, when first adjustable member 76 is moved forward along the strap members, the distance between first adjustable member 76 and the point of attachment of the forward ends of the strap members is decreased such that force $F_1$ is exerted on each attaching flap 58 in a direction towards the center of the shoe and substantially perpendicular to the longitudinal axis A. The further forward first adjustable member 76 is moved, the greater the force $F_1$ exerted on attaching flaps 58. Because first adjustable member 76 is positionable at a number of positions along the strap members as it is moved forward, the forepart portion of the upper can be adjusted with great variability such that a shoe wearer can individually conform the upper to his or her individual foot structure.

The movement of second adjustable member 78 rearward along the strap members tightens the rearward section of the arch portion of the upper and the heel portion of the upper. The positioning of the rearward ends of strap members 66 and 68 along the side of the shoe in the heel portion of the shoe and along the side of the ankle of the foot allow the strap members to tighten the upper about the ankle and the heel of the foot. For example, with reference to FIG. 3, the positioning of the rearward ends of strap members 66 and 68 in the heel portion of the shoe along the side of the ankle allow strap members 66 and 68 to partially surround the ankle of the wearer and to be adjustably tightened around the ankle. Further, the attachment of the rearward ends of strap members 66 and 68 at an angle $\beta$ (which is preferably approximately 45° ) allows a force $F_2$ directed inward toward the center of the shoe to be applied to the upper in the heel portion of the shoe such that the upper is tightened across the top of the foot in front of the ankle and around the ankle. Because of the angle of attachment $\beta$ , force $F_2$ is directed both upwardly and forwardly. In other words, the angle $\beta$ ensures that when second adjustable member 78 is moved rearward, force $F_2$ has a "y" component directed inwardly, upwardly and perpendicular to the shoe's longitudinal axis A such that the "y" component tightens the upper about the top of the foot and an "x" component directed inwardly, forwardly and parallel to longitudinal axis A such that the upper is tightened around the ankle and heel of the foot. Moving second adjustable member 78 rearward decreases the distance between adjustable member 78 and the attachment points of the rearward ends of the strap members such that force $F_2$ is applied to the upper in the heel portion of the shoe. The further adjustable member 78 is moved rearward, the greater the force $F_2$ exerted on the upper in the heel portion.

With reference to FIG. 3 which shows the closure system in the tightened position, the generally parallel relationship of intermediate portions of first and second strap members 66 and 68 in the untightened position as shown in FIG. 2 is extended forward towards the forefoot portion of the shoe such that additional forward portions of strap members 66 and 68 are held in a generally parallel relationship and such that the shoe is tightened about the forefoot of the foot. Further, in the tightened position shown in FIG. 3 the length of the portions of strap members 66 and 68 in between first adjustable member 76 and the points of attachment of the forward ends of the strap members is decreased from the untightened position shown in FIG. 2, thus providing force $F_1$ to each attaching flap 58.

Additionally, the generally parallel relationship of intermediate portions of the strap members in the untightened position as shown in FIG. 2 is extended rearward towards the heel portion of the shoe such that additional rearward portions of strap members 66 and 68 are held in a generally parallel relationship and such that the shoe is tightened about the ankle and heel of the foot. Also, in the tightened position shown in FIG. 3 the length of the portions of strap members 66 and 68 in between second adjustable member 78 and the points of attachment of the rearward ends of the strap members is decreased from the untightened position shown in FIG. 2 such that a force $F_2$ is applied to each side of the upper in the heel portion.

With reference to FIG. 6, padded instep portion 32 prevents irritation along the top of the foot from first and second adjustable members 76 and 78.

The closure system provides the advantage that it can be operated and the shoe tightened about the foot simply by using a single hand. For instance, second adjustable member 78 can be first moved toward the rear of the foot using one hand to adjustably tighten the upper about the heel and ankle and then locked into place by actuating or snapping hinged member 88 downward. Thereafter, first adjustable member 76 can be moved forward using one hand to adjustably tighten the forefoot portion of the upper about the foot and then locked into place by actuating or snapping hinged member 88 into place. The simple locking of first and second adjustable members 76 and 78 in position by actuating or snapping hinged member 88 into place alleviates the need for tying a lace about the top of the foot. Thus, this simple locking arrangement allows ease of use, such that the closure system is suitable for children.

Further, the shoe can be easily untightened about the foot by simply unsnapping hinge members 88 of first and second adjustable members 76 and 78 and sliding first and second adjustable members 76 and 78 towards one another to more intermediate positions along the strap members. Thus, the shoe can be simply loosened using one hand without the need to untie a lace and loosen the laces within the eyelets to remove the shoe. As shown in FIG. 4, the closure system in the tightened position lays neatly across the top of the foot. Thus, an attractive low profile appearance is obtained. Additionally, there is no bulky crisscrossing structure of an extraneous lace positioned across the top of the foot, but simply two strap members positioned on the medial and lateral sides of the foot and two adjustable members attached to the strap members.

Still further, the closure system can be particularly useful when the quarter 30 is made of an elastic material to thus form an elastic "sleeve" which conforms to the shape of the foot. If a shoe has such an elastic sleeve, the closure system can be used to effectively tighten the elastic sleeve about the foot and provide a structured feel to the elastic sleeve. Such a structured feel and tightening ability can be accomplished by ensuring that strap members 66 and 68 are attached at their forward and rearward ends to substantially non-elastic, non-stretch structures which in turn are attached to the shoe sole. For instance, with reference to Figure 1, if quarter layer 30 is made of an elastic material, the forward ends of strap members 66 and 68 can be attached to attaching flaps 58 which are attached to or coextensive with reinforcing side sections 52. Reinforcing side sections 52 are either directly or indirectly attached to sole 20. The attaching flaps 58 and the reinforcing side sections 52 can be made of a substantially non-elastic, nonstretchable material, for example synthetic or natural leather. Further, the rearward ends of strap members 66 and 68 can be attached to foxing 40 or heel counter 44. Foxing 40 and heel counter 44 can both be made of a substantially non-elastic, non-stretchable material, for example, synthetic or natural leather or plastic, and both can be directly or indirectly attached to sole 20. Thus, as is apparent, the forward and rearward ends of strap members 66 and 68 can be attached to shoe structures that are attached to the sole and that are made of a substantially non-elastic material such that the elastic quarter layer 30 can be tightened about the foot and the shoe can have a relatively firm and structured feel.

As described above, strap members 66 and 68 are preferably made of a material which is elastic such that the elasticity of the strap members allows them to deform during the tightening of the system to allow for more adjustability of the upper about the foot. Further, it will be understood by one of ordinary skill in the art that although the strap members 66 and 68 are described above as cylindrical cord members, strap members 66 and 68 can also be of any configuration, such as a flat strap. In such a system, adjustable members can be adopted to slide along the configuration of the strap member.

As shown in FIG. 1, first and second adjustable members 76 and 78 are disposed along strap members 66 and 68 in an orientation such that hinged members 88 of the adjustable members rotate or actuate away from one another into an unlocked position. First and second adjustable members 76 and 78 will work equally as well if coupled to strap members 66 and 68 in positions turned 180° from that shown in FIG. 1 such that hinged members 88 of first and second adjustable members 76 and 78 rotate towards one another to an unlocked position. Additionally, the adjustable members will work equally as well if only one of the adjustable members is turned 180° from its position shown in FIG. 1 and coupled to strap members 66 and 68 such that hinged members 88 of the adjustable members rotate to the unlocked position in the same direction.

Figure 10:
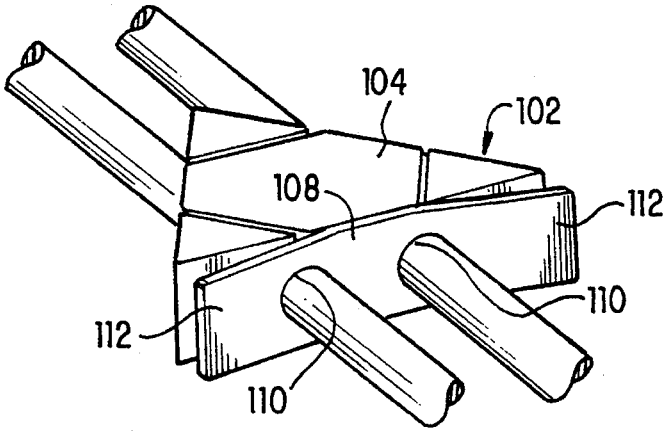
FIG. 10 shows a perspective view of an alternative adjusting member for the closure system of the present invention.
Figure 11:
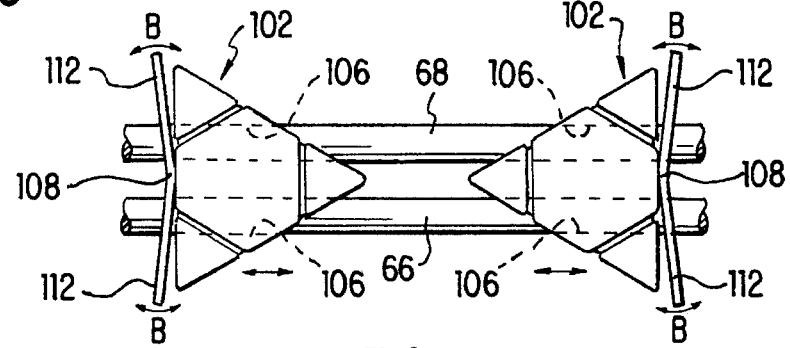
FIG. 11 is a top plan view of two of the adjusting members of FIG. 10 disposed on the strap members of the closure system of the present invention.

With reference to FIGS. 10 and 11, alternative adjustable members 102 are described. One of alternative adjustable members 102 is shown in a perspective view in FIG. 10 and the other adjustable member has an identical structure. Base 104 has apertures 106 disposed therein for receiving the strap members. Lock washer 108 is disposed on the end of base 104. Lock washer 108 also has apertures 110 disposed therein for receiving the strap members. Lock washer 108 is resiliently attached at its middle to base 104 such that its end sections 112 can be resiliently deformed as indicated by arrows B in FIG. 11. The positioning of the two alternative adjustable members 102 along strap members 66 and 68 is shown in FIG. 11. In order to tighten the closure system using adjustable members 102, adjustable members 102 are moved away from one another. The structure of lock washer 108 allows the adjustable members 102 to be moved away from one another without the shoe wearer actuating lock washers 108. As the adjustable members 102 are moved away from one another, end sections 112 of lock washers 108 pivot inward toward bases 104 such that the strap members are unclenched in apertures 110. After the movement of adjustable members 102 stops, end sections 112 are pivoted away from bases 104 because of the resilient attachment of lock washers 108 to bases 104 thus clenching the strap members and holding the adjustable members 102 in position. Thus, after the adjustable members have been moved away from one another they are automatically held in place by end sections 112 of lock washer 108. In order to release the adjustable members 102, end sections 112 of lock washers 108 are pivoted inward by the shoe wearer thus unclenching the strap members in apertures 110 and allowing the shoe wearer to move adjustable members 102 towards one another to loosen the tightening system. Thus, the pivoting of end sections 112 of lock washers 108 such that the strap members are unclenched in apertures 110 allows alternative adjustable members 102 to be moved in one direction only without actuating the lock washers and to be held at a position after they have been moved in that direction.

Figure 12:
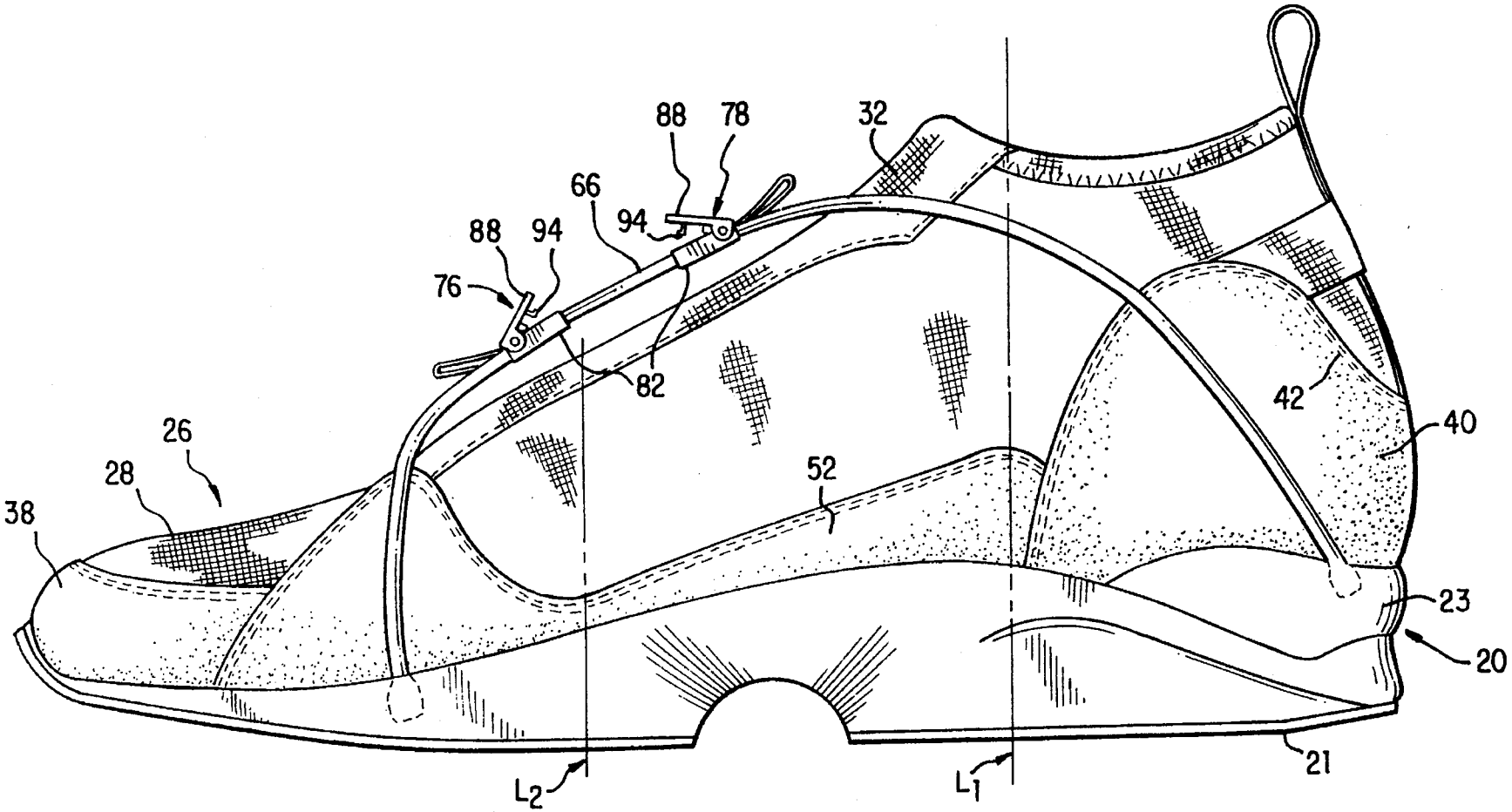
FIG. 12 shows a side elevational view of an alternative embodiment of the present invention.

With reference to FIG. 12, an alternative embodiment of the present invention is shown. In this embodiment, reference numerals used to indicate structures in previous embodiments are used to indicate the same or similar structures in this embodiment. In this embodiment the forward and rearward ends of strap members 66 and 68 are attached directly to the top of sole 20 instead of being attached to the upper. The forward ends of strap members 66 and 68 are attached to sole 20 in the forepart portion of the shoe and the rearward ends of strap members 66 and 68 are attached to sole 20 in the heel portion of the shoe. The strap members can be attached to sole 20 by any suitable means such as stitching, glue, or adhesive. The closure system in FIG. 12 is shown in an untightened position. The closure system shown in FIG. 12 is tightened in the same manner as described in the above embodiments.

The strap members of the present invention can also be attached such that the forward ends of the strap members are attached to the upper and the rearward ends of the strap members are attached to the sole, and vice versa. Other attaching combinations are also possible such as one strap attached entirely to the upper and the other attached entirely to the sole.

Figure 13:
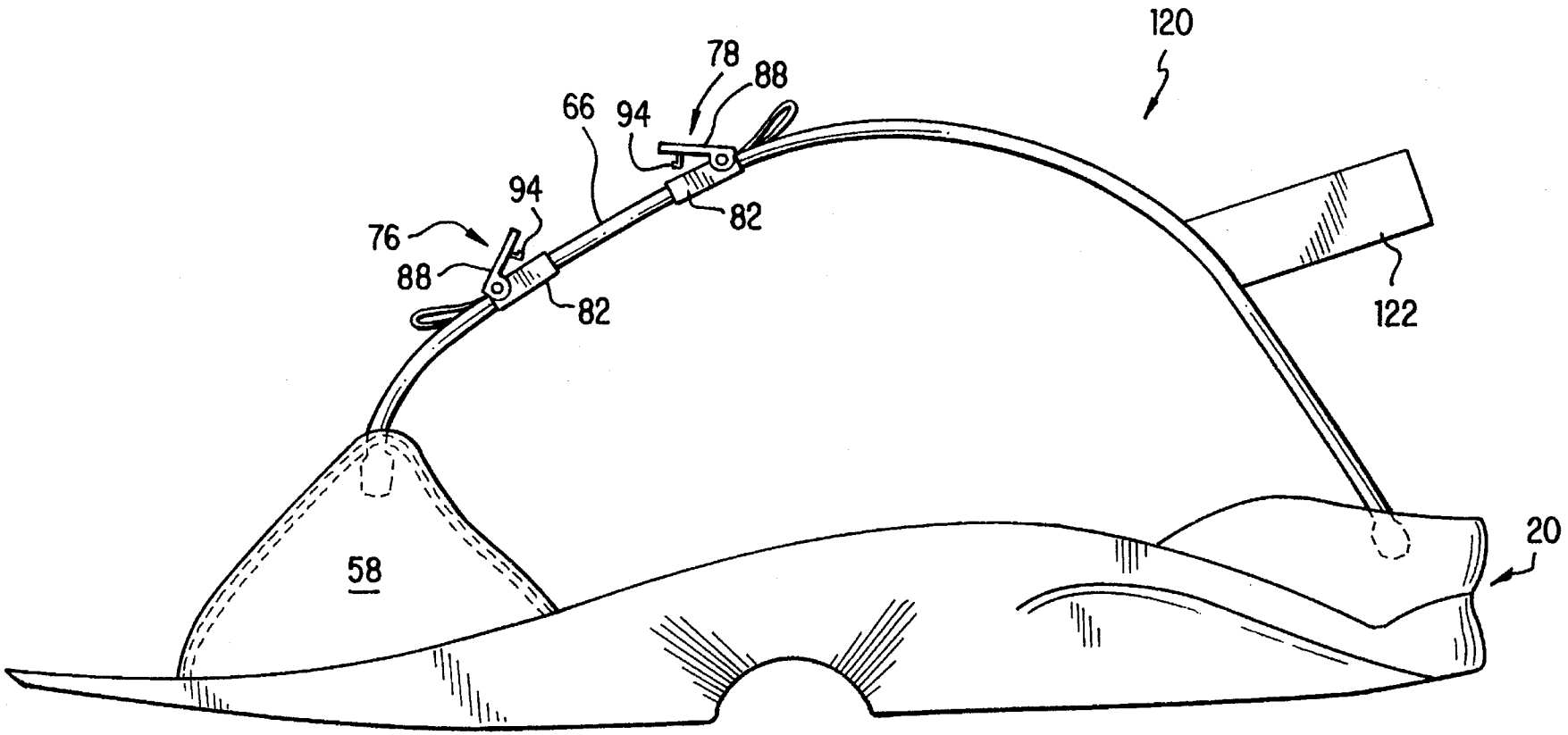
FIG. 13 shows a side elevational view of a further alternative embodiment of the present invention.

With reference to FIG. 13, a further alternative embodiment of the present invention is shown. In this embodiment, reference numerals used to indicate structures in previous embodiments are used to indicate the same or similar structures in this embodiment. This embodiment is directed generally to a sandal using the cord closure system of the present invention. Sandal 120 has attaching flaps 58 attached to sole 20 in the forepart portion of the sandal. The forward ends of strap members 66 and 68 are attached to attaching flaps 58 in the same manner as described above with regard to the other embodiments. The rearward ends of strap members 66 and 68 are attached to sole 20 in the heel portion of the sandal in the same manner as described above with regard to the other embodiments. Sandal 120 further has heel strap 122 which extends around the heel of the sandal wearer and is attached to both strap members 66 and 68. Heel strap 122 can be attached to strap members 66 and 68 in any suitable fashion, for example stitching, glue, or any other suitable adhesive. Alternatively, a single strap can be used and passed through guides in the heel area.

The closure system in FIG. 13 is shown in the untightened position. The closure system shown in FIG. 13 is tightened about the foot of the sandal wearer in the same manner as described above with regard to the other embodiments. More particularly, adjustable member 78 can be first moved towards the rear of the foot to adjustably tighten strap members 66 and 68 and heel strap member 122 about the heel and ankle of the sandal wearer and to thus secure the heel portion of sole 20 to the foot of the sandal wearer. Thereafter, adjustable member 76 can be moved forward to adjustably tighten attaching flaps 58 about the foot of the sandal wearer in the forefoot region.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of the parts within the principle of the invention to the full extent indicated by the broad general meaning of the terms in which the appended claims are expressed.

We claim:

1. A shoe having a closure system, comprising:

an upper;

a sole attached to said upper;

a first strap member attached to the medial side of the shoe at two longitudinal locations;

a second strap member attached to the lateral side of the shoe at two longitudinal locations;

a first adjusting member slidably coupled to both said first and second strap members, said first adjusting member slidable along said first and second strap members towards the front of the foot to adjustably tighten the upper about the forefoot of the foot; and a second adjusting member slidably coupled to both said first and second strap members, said second adjusting member slidable along said first and second strap members towards the rear of the foot to adjustably tighten the upper about the ankle and heel of the foot;

wherein said first strap member is attached at a first location in the forefoot portion of the shoe and at a second location in the heel portion of the shoe and wherein said second strap member is attached at a first location in the forefoot portion of the shoe and at a second location in the heel portion of the shoe; and wherein said first and second strap members are attached to one of the sole and the upper of the shoe and said second locations of said first and second strap members are located intermediate the top of said upper in the heel portion of the shoe and the top of said sole.

2. The shoe of claim 1 wherein said first locations of said first and second strap members are located along the sides of the forefoot portion of the shoe.

3. The shoe of claim 1 wherein said second locations of said first and second strap members are located along the sides of the ankle of the foot.

4. The shoe of claim 1 wherein said first and second strap members are attached at said first locations such that they extend from their respective attachment locations generally perpendicular to a longitudinal axis of the shoe, and said first and second strap members are attached at said second locations at an acute forward facing angle to the longitudinal axis of the shoe.

5. The shoe of claim 4 wherein said acute forward-facing angle is approximately 45°.

6. The shoe of claim 1 wherein said first and second strap members have a downward-facing generally arcuate shape when the shoe is untightened.

7. The shoe of claim 1 wherein said first and second strap members are attached to the sole of the shoe.

8. The shoe of claim 7 wherein said upper includes a first portion made of an elastic material, said first portion generally disposed in the arch portion of the shoe.

9. The shoe of claim 1 wherein said first and second strap members are cords.

10. The shoe of claim 1 wherein said first and second strap members are made of an elastic material.

11. The shoe of claim 1 wherein said first and second adjustable members each have a holding mechanism for securing the adjustable member at a particular position along the first and second strap members when the holding mechanism is actuated.

12. The shoe of claim 1 wherein said first locations of said first and second strap members are longitudinally located adjacent to the heads of the metatarsal bones of the foot.

13. The shoe of claim 1 wherein said first locations of said first and second strap members are longitudinally located behind the heads of the metatarsal bones of the foot.

14. The shoe of claim 1 further comprising a heel counter made of generally rigid material and disposed in the heel portion of the shoe, said first and second strap members attached to said heel counter at said second locations of said first and second strap members.

15. The shoe of claim 1 wherein said upper includes a first portion made of an elastic material and a second portion made of a substantially non-elastic material, wherein said second portion is disposed adjacent said sole, and wherein said first and second strap members are attached to said second portion.

16. The shoe of claim 15 wherein said first elastic portion of said upper is generally located in the arch portion of the shoe.

17. A shoe having a closure system, comprising an upper;

a sole attached to said upper;

a first strap portion extending along the medial side of the shoe with an end attached at a first location in the forefoot portion of the shoe;

a second strap portion extending along the lateral side of the shoe with an end attached at a first location in the forefoot portion of the shoe; and at least two adjusting members, coupled to said first and second strap portions, for adjusting the spacing between said first and second strap portions at a plurality of locations such that the upper is tightened about the heel and forefoot of the foot;

wherein said first and second strap portions are separate members, each of said first and second strap portions having a second end attached at a second location in the heel portion of the shoe; and wherein a first of said adjustable members is moveable towards the front of the foot to tighten the upper about the forefoot of the foot by shortening the effective length of said first and second strap members between said first adjustable member and said first locations of said first and second strap members to apply a tightening force generally inward toward the center of the shoe; and wherein a second of said adjustable member is moveable towards the rear of the foot to tighten the upper about the heel and ankle of the foot by shortening the effective length of said first and second strap members between said second adjustable member and said second locations of said first and second strap members to apply a tightening force generally inward toward the center of the shoe and generally forward towards the forefoot portion of the shoe.

18. The shoe of claim 17 wherein said first locations of said first and second strap members are located along the sides of the forefoot portion of the shoe.

19. The shoe of claim 17 wherein said second locations of said first and second strap members are located along the sides of the ankle of the foot.

20. The shoe of claim 17 wherein said first and second strap members are attached at said first locations such that they are generally perpendicular to a longitudinal axis of the shoe and said first and second strap members are attached at said second locations at an acute forward facing angle to the longitudinal axis of the shoe.

21. The shoe of claim 20 wherein said acute forward facing angle is approximately 45°.

22. The shoe of claim 17 wherein said first and second strap members have a downward-facing arcuate shape when the shoe is untightened.

23. The shoe of claim 17 wherein said first and second strap members are attached to the upper of the shoe.

24. The shoe of claim 17 wherein said first and second strap members are attached to the sole of the shoe.

25. The shoe of claim 17 wherein said first and second strap members are cords.

26. The shoe of claim 17 wherein said first and second strap members are made of an elastic material.

27. The shoe of claim 17 wherein said at least two adjustable members each have a holding mechanism for securing the adjustable member at a particular position along the first and second strap members when the holding mechanism is actuated.

28. The shoe of claim 17 wherein said first locations of said first and second strap members are longitudinally located adjacent to the heads of the metatarsal bones of the foot.

29. The shoe of claim 17 wherein said first locations of said first and second strap members are longitudinally located behind the heads of the metatarsal bones of the foot.

30. The shoe of claim 17 further comprising a heel counter made of generally rigid material and disposed in the heel portion of the shoe, said first and second strap members attached to said heel counter at said second locations of said first and second strap members.

31. The shoe of claim 17 wherein at least one of said first and second strap portions extends through an aperture located in the heel portion of said upper.

32. A shoe having a closure system, comprising:

an upper having an elastic portion generally disposed in the arch portion of the shoe and a non-elastic portion generally disposed in the forefoot and heel portions of the shoe;

a sole attached to said upper;

a first strap member attached on the medial side of the shoe to said non-elastic portion of said upper, said first strap member attached at a first location in the forefoot portion of the shoe and at a second location in the heel portion of the shoe;

a second strap member attached on the lateral side of the shoe to said non-elastic portion of said upper, said second strap member attached at a first location in the forefoot portion of the shoe and at a second location in the heel portion of the shoe;

at least two adjusting members, coupled to said first and second strap members, for adjusting the spacing between said first and second strap members at a plurality of locations such that said upper is tightened about the heel and forefoot of the foot.

33. A sandal having an attaching system, comprising;

a sole;

a first strap portion extending along the medial side of the sandal with an end attached at a first location in the forefoot portion of the sandal;

a second strap portion extending along the lateral side of the sandal with an end attached at a first location in the forefoot portion of the sandal;

at least two adjusting members, coupled to said first and second strap portions, for adjusting the spacing between said first and second strap portions at a plurality of locations such that the sole of the sandal is adjustably tightened to the heel and forefoot of the foot; and a heel strap secured to both said first and second strap portions and extending around the heel of the foot;

wherein said first and second strap portions are separate members, each of said first and second strap portions having a second end attached at a second location in the heel portion of the sandal; and wherein said first and second strap portions are attached at said first locations such that they are generally perpendicular to a longitudinal axis of the sandal and said first and second strap members are attached at said second locations at an acute forward facing angle to the longitudinal axis of the sandal.

34. The sandal of claim 33 wherein a first of said adjustable members is moveable towards the front of the foot to adjustably tighten the sole to the forefoot of the foot by shortening the effective length of said first and second strap members between said first adjustable member and said first locations of said first and second strap members to apply a tightening force generally inward toward the center of the sandal, and wherein a second of said adjustable members is moveable towards the rear of the foot to adjustably tighten the sole to the heel and ankle of the foot by shortening the effective length of said first and second strap members between said second adjustable member and said second locations of said first and second strap members to apply a tightening force generally inward toward the center of the sandal and generally forward towards the forefoot portion of the sandal.

35. The sandal of claim 33 wherein said first and second strap members have a downward-facing arcuate shape when the sandal is untightened.

36. The sandal of claim 33 wherein said first and second strap members are attached to the sole of the sandal.

37. The sandal of claim 33 wherein said first and second strap members are cords.

38. The sandal of claim 33 wherein said first and second strap members are made of an elastic material.

39. The sandal of claim 33 wherein said at least two adjustable members each have a holding mechanism for securing the adjustable member at a particular position along the first and second strap members when the holding mechanism is actuated.

40. The sandal of claim 33 wherein said first locations of said locations of said first and second strap members are longitudinally located adjacent to the heads of the metatarsal bones of the foot.

41. The sandal of claim 33 wherein at least one of said first and second strap portions extends through a guide in the heel portion of the sandal.

42. A shoe having a closure system, comprising an upper;

a sole attached to said upper;

a first strap portion extending along the medial side of the shoe with an end attached at a first location in the forefoot portion of the shoe;

a second strap portion extending along the lateral side of the shoe with an end attached at a first location in the forefoot portion of the shoe, said first and second strap portions being separate members and each of said first and second strap portions having a second end attached at a second location in the heel portion of the shoe;

at least two adjusting members, coupled to said first and second strap portions, for adjusting the spacing between said first and second strap portions at a plurality of locations such that the upper is tightened about the heel and forefoot of the foot; and a heel counter made of generally rigid material and disposed in the heel portion of the shoe, said first and second strap portions attached to said heel counter at said second locations of said first and second strap portions.

43. A shoe having a closure system, comprising:

an upper;

a sole attached to said upper;

a first strap member attached to the medial side of the shoe at two longitudinal locations;

a second strap member attached to the lateral side of the shoe at two longitudinal locations;

a first adjusting member slidably coupled to both said first and second strap members, said first adjusting member slidable along said first and second strap members towards the front of the foot to adjustably tighten the upper about the forefoot of the foot; and a second adjusting member slidably coupled to both said first and second strap members, said second adjusting member slidable along said first and second strap members towards the rear of the foot to adjustably tighten the upper about the ankle and heel of the foot;

wherein said first strap member is attached at a first location in the forefoot portion of the shoe and at a second location in the heel portion of the shoe and wherein said second strap member is attached at a first location in the forefoot portion of the shoe and at a second location in the heel portion of the shoe; and wherein said upper includes a first portion made of an elastic material and a second portion made of a substantially non-elastic material, wherein said second portion is disposed adjacent said sole, and wherein said first and second strap members are attached to said second portion.

* * * * *